US010395854B2

(12) United States Patent
Schaltenbrand et al.

(10) Patent No.: US 10,395,854 B2
(45) Date of Patent: Aug. 27, 2019

(54) ELECTRICAL SWITCHING APPARATUS, AND CROSSBAR ASSEMBLY AND SPRING CAP THEREFOR

(71) Applicant: EATON CORPORATION, Cleveland, OH (US)

(72) Inventors: Brian John Schaltenbrand, Pittsburgh, PA (US); Andrew Lawrence Gottschalk, Monaca, PA (US); David Curtis Turner, Imperial, PA (US); James P. Sisley, Baden, PA (US); Lisa Ann Buono, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 49 days.

(21) Appl. No.: 15/807,014

(22) Filed: Nov. 8, 2017

(65) Prior Publication Data

US 2019/0139717 A1 May 9, 2019

(51) Int. Cl.
*H01H 3/38* (2006.01)
*H01H 3/02* (2006.01)

(52) U.S. Cl.
CPC ..... *H01H 3/38* (2013.01); *H01H 3/02* (2013.01); *H01H 2235/01* (2013.01)

(58) Field of Classification Search
CPC ..... H01H 3/38; H01H 3/02; H01H 2235/01
USPC ..... 200/290, 400, 401
See application file for complete search history.

(56) References Cited

U.S. PATENT DOCUMENTS 3,218,428 A * 11/1965 Gauthier ..... H01H 1/226 200/244
5,924,554 A * 7/1999 Dosmo ..... H01H 77/104 200/400
7,238,910 B1 7/2007 Puskar et al.
8,039,770 B2 10/2011 Schaltenbrand et al.
8,872,050 B2 * 10/2014 Hierl ..... H01H 1/205 200/244

* cited by examiner

*Primary Examiner* — Edwin A. Leon
*Assistant Examiner* — Lheiren Mae A Caroc
(74) *Attorney, Agent, or Firm* — Eckert Seamans Cherin & Mellott, LLC

(57) ABSTRACT

A spring cap for an electrical switching apparatus having a housing, a stationary contact, a movable contact disposed on a moving arm, and a crossbar assembly. The crossbar assembly includes a crossbar, a first contact spring, a second contact spring, and a spring clip. The moving arm is coupled to the crossbar. The spring cap includes a first segment structured disposed between the spring clip and the first contact spring, a second segment disposed between the spring clip and the second contact spring, and a connecting portion connecting the first segment to the second segment. The spring clip is disposed between the moving arm and the contact springs. The spring cap supports the spring clip and evenly distribute bias forces of the contact springs.

13 Claims, 5 Drawing Sheets

ELECTRICAL SWITCHING APPARATUS, AND CROSSBAR ASSEMBLY AND SPRING CAP THEREFOR

BACKGROUND

Field

The disclosed concept relates generally to electrical switching apparatus and, more particularly, to electric switching apparatus, such as for example, circuit breakers. The disclosed concept also relates to crossbar assemblies for circuit breakers. The disclosed concept further relates to spring caps for crossbar assemblies.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit.

The electrical contacts generally comprise one or more movable contacts and one or more corresponding stationery contacts. Each pair of separable contacts is electrically connected, in series, between corresponding line and load terminals which are typically positioned at opposite ends of the circuit breaker. More specifically, each movable contact is disposed at or about a first end of a corresponding moving arm, which is part of a movable contact assembly. The moving arm is pivotably coupled, at or about its second end, to a crossbar of the operating mechanism. A suitable shunt (e.g., without limitation, flexible conductor) electrically connects the movable contact assembly to a load conductor. The operating mechanism controls the moving arm to pivot the movable contact(s) into and out of electrical contact with the corresponding stationary contact(s). The crossbar carries the moving arms for all of the poles of the circuit breaker, and allows for simultaneous opening and closing in all of the poles.

Contact pressure between the stationery and movable contacts is typically achieved using contact springs (e.g., compression springs), which are held in desired positions with respect to corresponding moving arms via spring clips coupled to the crossbar assembly. The spring clips can deform as a result of forces, for example, forces associated with blow-off operation. Such deformation can adversely affect breaker performance, for example, by resulting in inconsistent breaker contact force.

There is room for improvement in electrical switching apparatus, and in crossbar assemblies and spring caps therefor.

SUMMARY

These needs and others are met by embodiments of the invention, which are directed to a spring cap for a crossbar assembly of an electrical switching apparatus.

As one aspect of the disclosed concept, a spring cap is provided for an electrical switching apparatus. The electrical switching apparatus comprises a housing, a stationary contact, a movable contact disposed on a moving arm, and a crossbar assembly. The crossbar assembly comprises a crossbar, a first contact spring, a second contact spring, and a spring clip. The moving arm is coupled to the crossbar. The spring cap comprises: a first segment structured to be disposed between the spring clip and the first contact spring; a second segment structured to be disposed between the spring clip and the second contact spring; and a connecting portion connecting the first segment to the second segment. The spring clip is disposed between the moving arm and the contact springs. The spring cap is structured to support the spring clip and evenly distribute bias forces of the first contact spring and the second contact spring.

The spring cap may be a unitary member consisting of one single piece of material, wherein the connecting portion is a molded web of material interconnecting the first segment and the second segment. The crossbar may include a molded recess, wherein the spring cap is structured to engage the first contact spring and the second contact spring within the molded recess, wherein the molded web of material functions as a rejection feature, and wherein the rejection feature is structured to only permit the spring cap to be disposed within the molded recess in one single predetermined orientation.

As another aspect of the disclosed concept, a crossbar assembly is provided for an electrical switching apparatus. The electrical switching apparatus comprises a housing, a number of a stationary contacts, a number of movable contacts, and a number of moving arms. Each of the movable contacts is disposed on a corresponding one of the moving arms. The crossbar assembly comprises: a crossbar structured to pivot the number of moving arms thereby moving the movable contacts into and out of electrical communication with the stationary contacts, the crossbar having a number of molded recesses; a pair of contact springs disposed in each of the molded recesses; a spring clip enclosing the pair of contact springs within the molded recess, the spring clip being disposed between a corresponding one of the moving arms and the pair of contact springs; and a spring cap cooperating with the pair of contact springs within the molded recess, each spring cap comprising: a first segment disposed between the spring clip and a first contact spring of the pair of contact springs, a second segment disposed between the spring clip and a second contact spring of the pair of contact springs, and a connecting portion connecting the first segment to the second segment. The spring cap supports the spring clip and evenly distributes bias forces of the first contact spring and the second contact spring.

As a further aspect of the disclosed concept, an electrical switching apparatus comprises: a housing; a number of a stationary contacts; a number of movable contacts; a number of moving arms, each of the movable contacts being disposed on a corresponding one of the moving arms; and a crossbar assembly comprising: a crossbar for pivoting the moving arms thereby moving the movable contacts into and out of electrical communication with the stationary contacts, the crossbar having a number of molded recesses, a pair of contact springs disposed in each of the molded recesses, a spring clip enclosing the pair of contact springs within the molded recess, the spring clip being disposed between a corresponding one of the moving arms and the pair of contact springs, and a spring cap cooperating with the pair of contact springs within the molded recess, each spring cap comprising: a first segment disposed between the spring clip and a first contact spring of the pair of contact springs, a second segment disposed between the spring clip and a second contact spring of the pair of contact springs, and a connecting portion connecting the first segment to the second segment. The spring cap supports the spring clip and evenly distributes bias forces of the first contact spring and the second contact spring.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
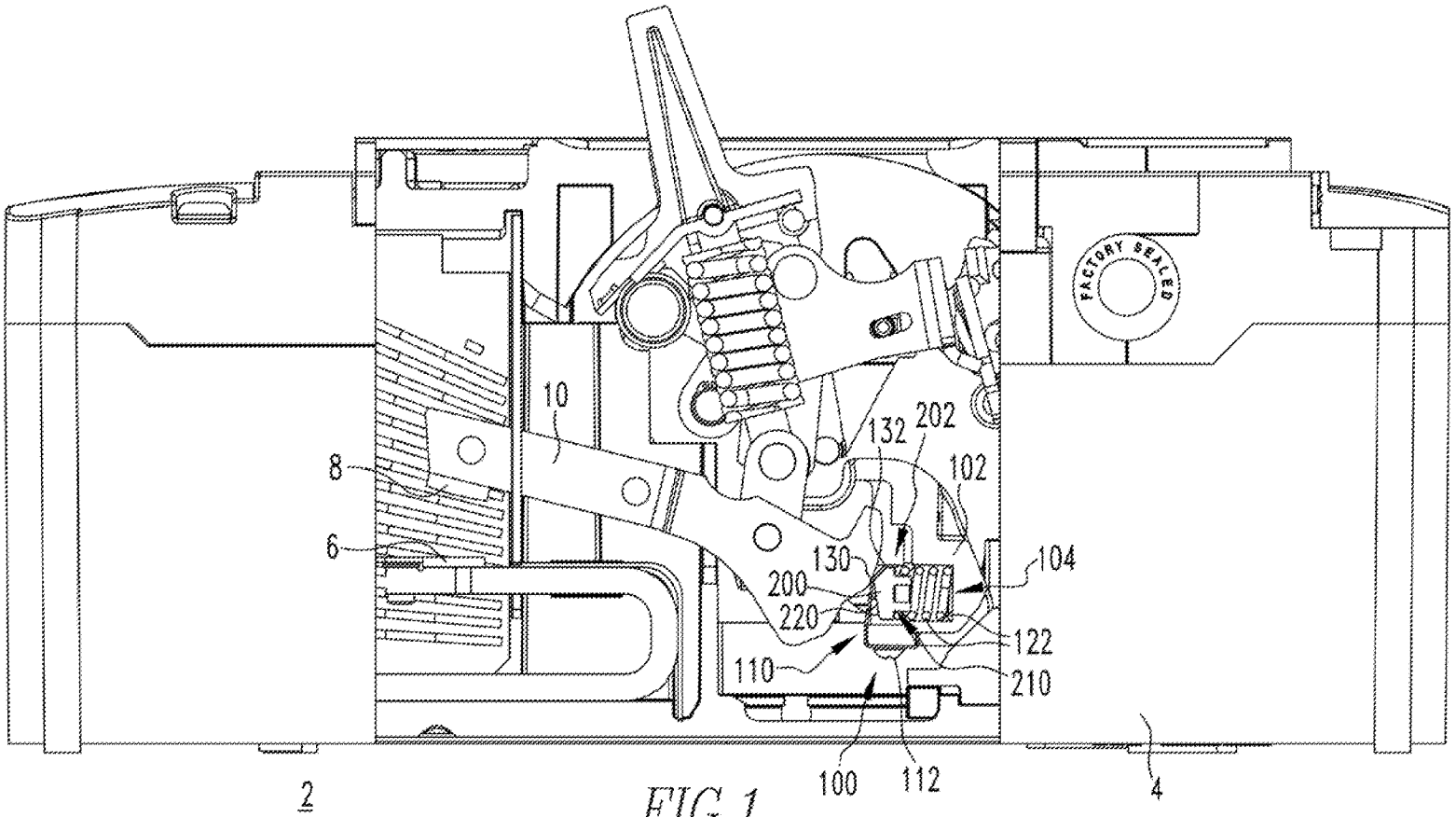
FIG. 1 is a section view of an electrical switching apparatus, and crossbar assembly and spring cap therefor, in accordance with a non-limiting embodiment of the disclosed concept.

Directional phrases used herein, such as, for example, front, back, top, bottom and derivatives thereof, relate to the orientation of the elements shown in the drawings and are not limiting upon the claims unless expressly recited therein. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrase "directly connected" shall mean that two or more parts are joined together directly, without any intermediate parts being disposed therebetween at the point or location of the connection.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

FIG. 1 shows an electrical switching apparatus, such as for example and without limitation, a circuit breaker 2 (shown in partial section view to illustrate certain internal components), employing a crossbar assembly 100 and spring cap 200 therefor, in accordance with the disclosed concept. In the non-limiting example shown, the circuit breaker 2 includes a housing 4, a number of stationery or fixed contacts 6 (one stationary contact 6 is shown in FIG. 1) enclosed by the housing 4, and a corresponding number of movable contacts 8 (one movable contact 8 is shown in FIG. 1). Each movable contact 8 is mounted on a corresponding moving arm 10, as shown. The disclosed concept is shown and described herein in connection with a three-pole circuit breaker 2 having three poles 50,60,70 (all shown in FIGS. 2, 3 and 4). It will be appreciated, however, that it could be employed with any known or suitable alternative electrical switching apparatus (not shown) having any known or suitable alternative number of poles (not shown). The disclosed crossbar assembly 100 employs substantially similar components for each of the poles 50,60,70 (all shown in FIGS. 2, 3 and 4), including the spring cap 200 in accordance with the disclosed concept. It will be appreciated that for ease of illustration and economy of disclosure, the disclosed crossbar assembly 100 and spring cap 200 therefor will only be described in detail with respect to one of the poles (e.g., pole 50).

Figure 2:
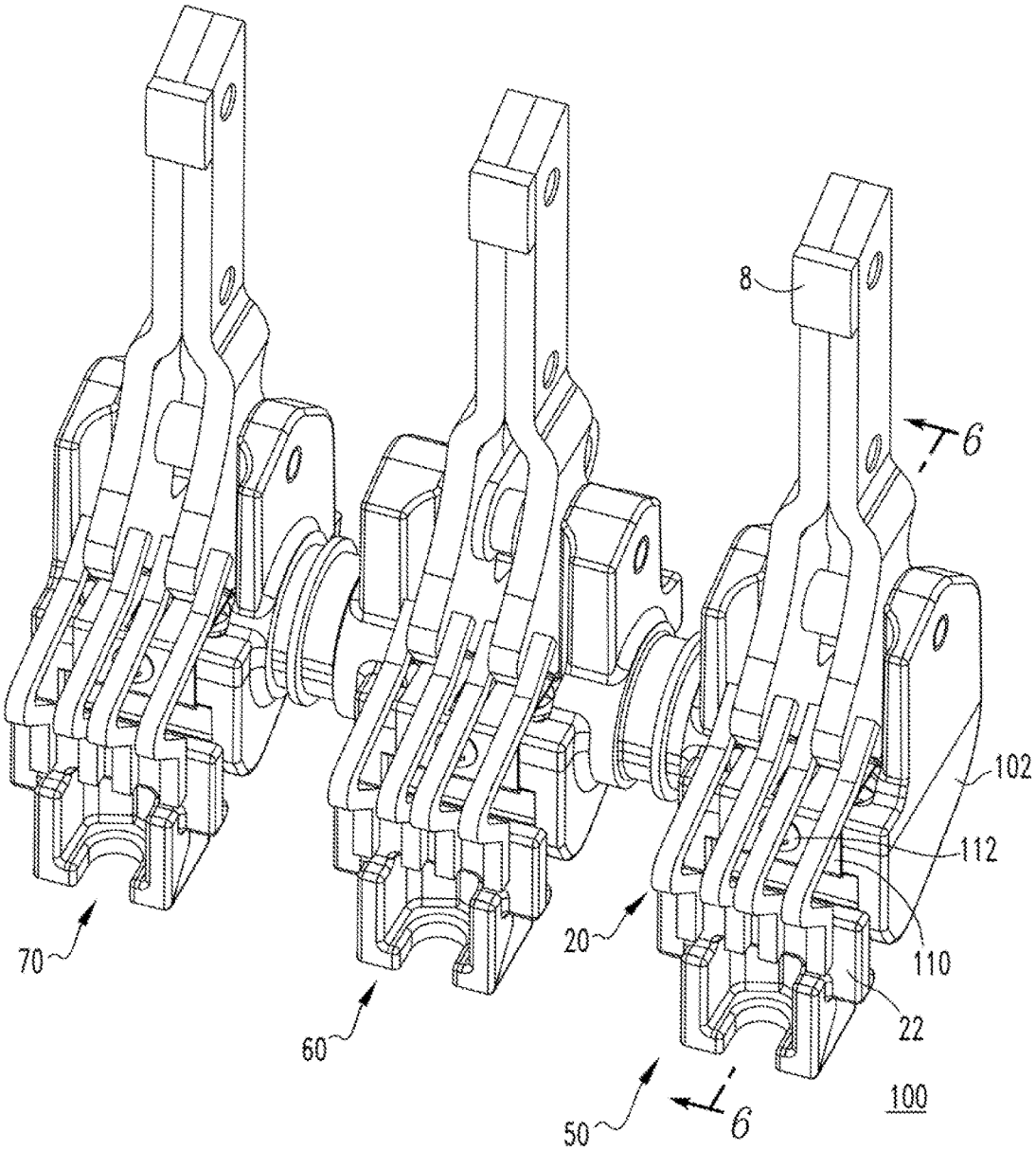
FIG. 2 is an isometric view of the crossbar assembly and spring cap therefor of FIG. 1.
Figure 3:
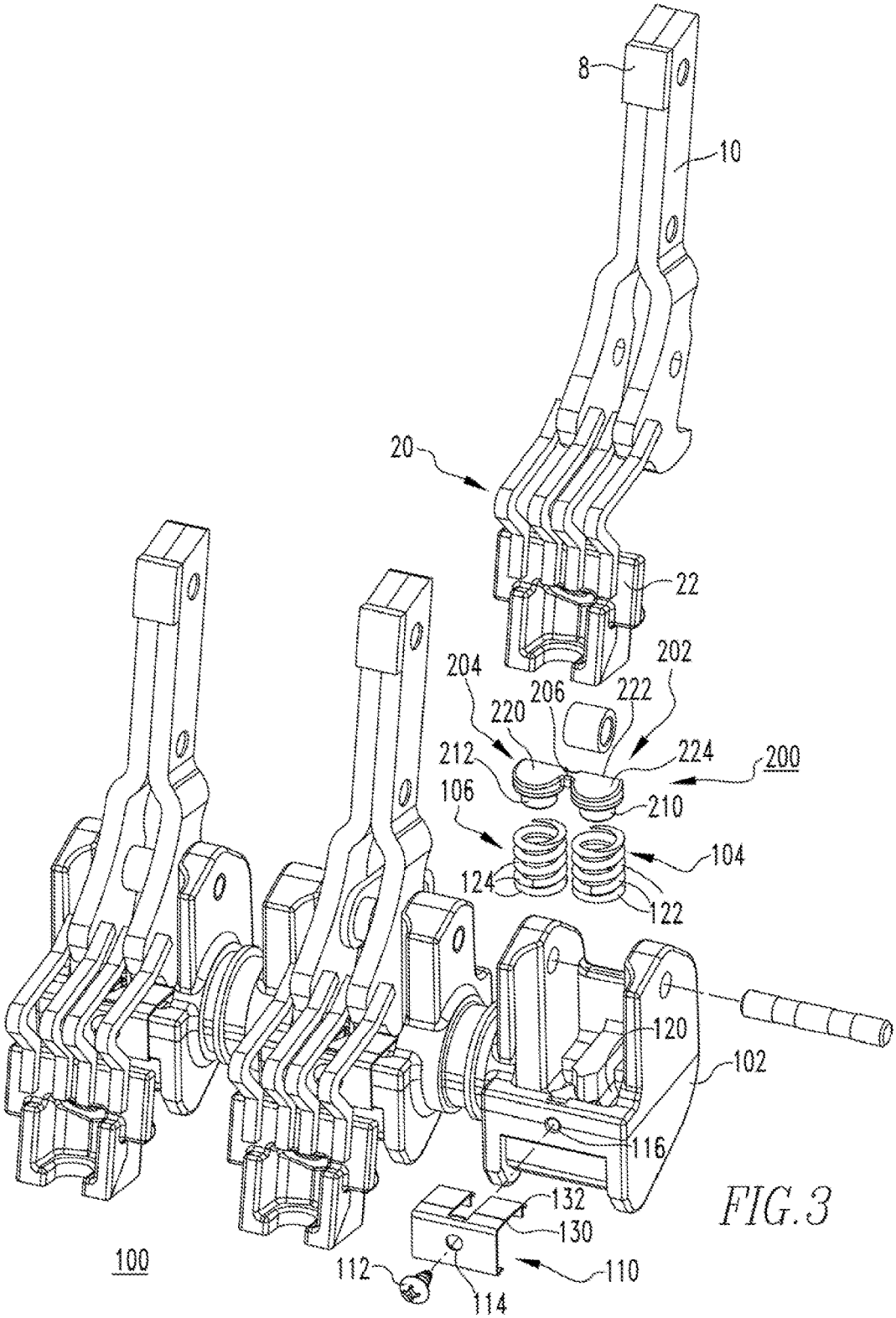
FIG. 3 is a partially exploded isometric view of the crossbar assembly and spring cap therefor of FIG. 2.
Figure 4:
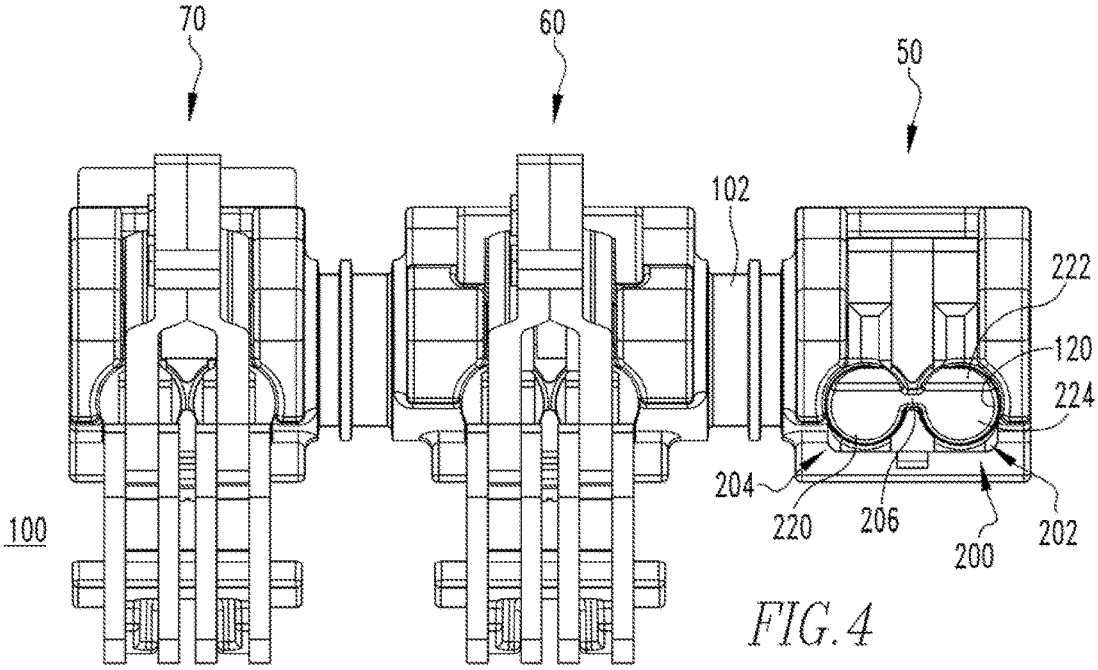
FIG. 4 is an end elevation view of the crossbar assembly and spring cap therefor of FIG. 3, modified to remove certain features from one of the poles.

Continuing to refer to FIG. 1, and also to FIGS. 2-4, the crossbar assembly 100 includes a crossbar 102, which is structured to pivot thereby pivoting the moving arms 10 (three moving arms 10 are shown in FIG. 2-4) to move the movable contacts 8 into and out of electrical communication with the corresponding stationery contacts (e.g., for example, stationary contact 6 of FIG. 1), in a generally well known manner. In the example shown, flexible electrical conductors (e.g., without limitation, shunts 20) electrically connect each moving arm 10 to a corresponding shunt tab 22 (FIGS. 2 and 3).

As shown in FIG. 3, the crossbar 102 includes a number of molded recesses 120. A pair of contact springs 104,106 is disposed within the molded recess 120, and a spring clip 110 encloses the contact springs 104,106 within the molded recess 120. That is, the spring clip 10 is disposed between the contact springs 104,106 and the moving arm 10, as best shown in FIG. 1 and FIGS. 6, 7 and 9. The example spring clip 110 is fastened to the crossbar 102 via a suitable fastener (e.g., without limitation, screw 112), which extends through a thru hole 114 in the spring clip 110 into a threaded hole in the crossbar 102 proximate the molded recess 120. It will be appreciated, however, that any known or suitable alternative fastener (not shown) or fastening mechanism (not shown) may be employed to suitably secure the spring clip 110 to the crossbar 102, as desired.

Figure 5:
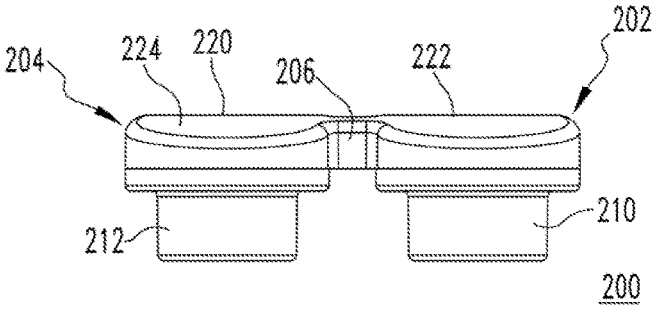
FIG. 5 is a plan view of a portion of the crossbar assembly of FIG. 4.
Figure 6:
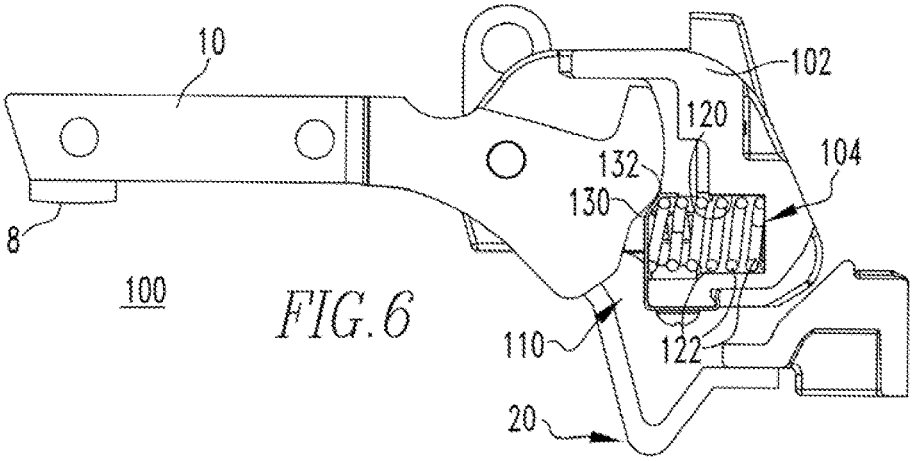
FIG. 6 is a section view taken along line 6-6 of FIG. 2.
Figure 7:
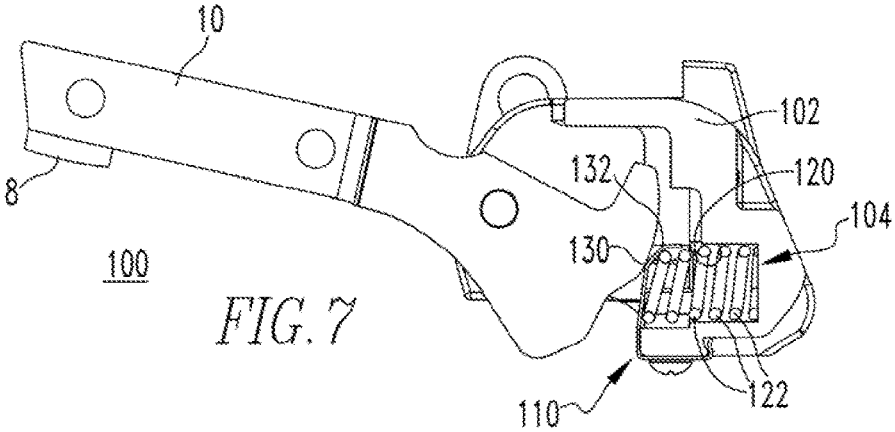
FIG. 7 is another section view of the crossbar assembly and spring cap therefor of FIG. 6, modified to show the assembly without the shunt and shunt tab, with the movable contact arm in a different position.
Figure 8:
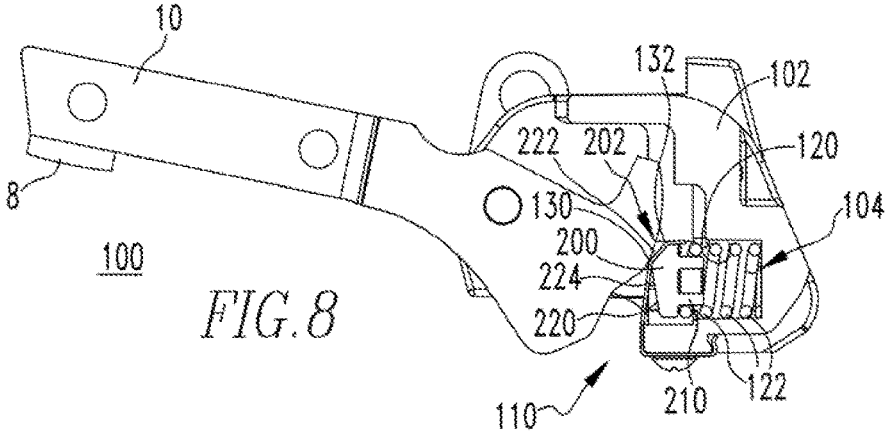
FIG. 8 is another section view of the crossbar assembly and spring cap therefor of FIG. 7, also showing additional features in section view.

The spring cap 200 cooperates with the contact springs 104,106. Continuing to refer to FIG. 3, and also to FIGS. 4, 5 and 9, it will be appreciated that the spring cap 200 in the example shown and described herein includes a first segment 202, which is disposed between the spring clip 110 and a first contact spring 104 of the pair of contact springs 104,106, and a second segment 204 disposed between the spring clip 110 and a second contact spring 106 of the pair of contact springs 104,106. A connecting portion 206 connects the first and second segments 202,204. Therefore, as will be described in greater detail herein, the disclosed spring cap 200 is structured to support the spring clip 110 and to evenly distribute bias forces provided by the first and second contact springs 104,106 on the spring clip 110 and, in turn, on the moving arm 10. In this manner, the disclosed crossbar assembly 100 and spring cap 200 eliminates deformation of the spring clip 110 while providing consistent contact force. This will be further appreciated with reference to FIGS. 6, 7 and 8, which are shown in partial section view to illustrate the cooperation of the contact spring 104, spring clip 110, spring cap 200 (FIG. 8), and moving arm 10, when the crossbar assembly 100 is in various positions and stages of operation.

Preferably, the spring cap 200 is a unitary member consisting of one single piece of material (e.g., without limitation, molded plastic). Thus, the connecting portion 206 comprises a molded web of material interconnecting the aforementioned first and second segments 202,204. It will be appreciated that the molded web of material that comprises the connecting portion 206 is structured to function as a "rejection feature." That is, the rejection feature molded web of material 206 is configured so as to only permit the spring cap 200 to be installed within the molded recess 120 in one single predetermined configuration. In this manner, the spring cap 200 is designed to avoid incorrect installation of the spring cap 200, thereby avoiding improper assembly of the crossbar assembly 100 and problems that would result from such incorrect assembly.

Referring again to FIG. 3, the pair of contact springs 104,106 comprises a first compression spring 104 and a second compression spring 106. The first and second compression springs 104,106 both include a plurality of coils 122,124. The first segment 202 of the spring cap 200 includes a first projection 210 structured to extend into the coils 122 of the first compression spring 104 (see, for example, FIGS. 1 and 8), and the second segment 204 includes a second projection 212 structured to extend into the coils 124 of the second compression spring 106.

The spring clip 110 preferably has a predetermined geometry, and the first and second segments 202,204 together form a contact surface 220 having a predetermined profile. It will be appreciated that, in accordance with the disclosed concept, the predetermined profile of the spring cap contact surface 220 is structured to cooperate with the predetermined geometry of the spring clip 110, in order to suitably support the spring clip 110 as well as evenly distribute contact spring biasing forces on the spring clip 110 and, in turn, on the corresponding moving arm 10. In the example shown and described herein, the spring clip 110 includes a plurality of bends 130,132, which together create the aforementioned predetermined geometry, and the predetermined profile of the spring cap contact surface 220 comprises a plurality of angled surfaces 222,224 (best shown in FIGS. 3, 4 and 5). Each angled surface 222,224 is structured to engage the spring clip 110 between a corresponding pair of the bends 130,132 of the spring clip 110. The example contact surface 220 includes a first ramped portion 222 and a second ramped portion 224, wherein the first ramped portion 222 is disposed at a first angle and the second ramped portion 224 is disposed at a second, different angle. It will be appreciated, however, that the spring clip 110 could have any known or suitable alternative predetermined geometry (not shown) and the spring cap 200 could have any known or suitable alternative predetermined profile (not shown).

Accordingly, the disclosed crossbar assembly 100 and spring cap 200 therefor function to suitably support the spring clip 110, while also cooperating with the contact springs 104,106 and spring clip 110 to evenly distribute biasing forces on the spring clip 110 and bias the corresponding moving arm 10 as desired. Thus, the disclosed spring cap 200 advantageously avoids known prior art problems such as, for example and without limitation, spring clip deformation and inconsistent contact forces and breaker performance.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A spring cap for an electrical switching apparatus, said electrical switching apparatus comprising a housing, a stationary contact, a movable contact disposed on a moving arm, and a crossbar assembly, said crossbar assembly comprising a crossbar, a first contact spring, a second contact spring, and a spring clip, said moving arm being coupled to said crossbar, said spring cap comprising:

a first segment structured to be disposed between said spring clip and said first contact spring;

a second segment structured to be disposed between said spring clip and said second contact spring; and a connecting portion connecting the first segment to the second segment, wherein said spring clip is disposed between said moving arm and said contact springs, and wherein said spring cap is structured to support said spring clip and evenly distribute bias forces of said first contact spring and said second contact spring, wherein said spring clip has a predetermined geometry; wherein the first segment and the second segment together form a contact surface having a predetermined profile; and wherein said predetermined profile is structured to cooperate with said predetermined geometry of said spring clip, wherein said spring clip includes a plurality of bends; wherein said predetermined profile comprises a plurality of angled surfaces; and wherein each of said angled surfaces is structured to engage said spring clip between a corresponding pair of said bends, and wherein said plurality of angled surfaces includes a first ramped portion disposed at a first angle and a second ramped portion disposed at a second angle different from the first angle.

2. The spring cap of claim 1 wherein said spring cap is a unitary member consisting of one single piece of material; and wherein said connecting portion is a molded web of material interconnecting the first segment and the second segment.

3. The spring cap of claim 2 wherein said crossbar includes a molded recess; wherein said spring cap is structured to engage said first contact spring and said second contact spring within said molded recess; wherein said molded web of material functions as a rejection feature; and wherein said rejection feature is structured to only permit said spring cap to be disposed within said molded recess in one single predetermined orientation.

4. The spring cap of claim 1 wherein said first contact spring is a first compression spring; wherein said second contact spring is a second compression spring; wherein each of said first compression spring and said second compression spring has a plurality of coils; wherein the first segment includes a first projection structured to extend into the coils of said first compression spring; and wherein the second segment includes a second projection structured to extend into the coils of said second compression spring.

5. A crossbar assembly for an electrical switching apparatus, said electrical switching apparatus comprising a housing, a number of a stationary contacts, a number of movable contacts, and a number of moving arms, each of said movable contacts being disposed on a corresponding one of said moving arms, said crossbar assembly comprising:

a crossbar structured to pivot said number of moving arms thereby moving said movable contacts into and out of electrical communication with said stationary contacts, said crossbar having a number of molded recesses;

a pair of contact springs disposed in each of said molded recesses;

a spring clip enclosing said pair of contact springs within said molded recess, said spring clip being disposed between a corresponding one of said moving arms and said pair of contact springs; and a spring cap cooperating with said pair of contact springs within said molded recess, each spring cap comprising:

a first segment disposed between said spring clip and a first contact spring of said pair of contact springs, a second segment disposed between said spring clip and a second contact spring of said pair of contact springs, and a connecting portion connecting the first segment to the second segment, wherein said spring cap supports said spring clip and evenly distributes bias forces of said first contact spring and said second contact spring, wherein said spring clip has a predetermined geometry including a plurality of bends; wherein the first segment and the second segment together form a contact surface having a predetermined profile; wherein said predetermined profile comprises a plurality of angled surfaces; and wherein each of said angled surfaces engages said spring clip between a corresponding pair of said bends, and wherein said plurality of angled surfaces includes a first ramped portion disposed at a first angle and a second ramped portion disposed at a second angle different from the first angle.

6. The crossbar assembly of claim 5 wherein each of said spring caps is a unitary member consisting of one single piece of material; and wherein said connecting portion is a molded web of material interconnecting the first segment and the second segment.

7. The crossbar assembly of claim 6 wherein said molded web of material functions as a rejection feature to only permit said spring cap to be disposed within said molded recesses in one single predetermined orientation.

8. The crossbar assembly of claim 5 wherein said first contact spring is a first compression spring having a plurality of coils; wherein said second contact spring is a second compression spring having a plurality of coils; wherein the first segment includes a first projection extending into the coils of said first compression spring; and wherein the second segment includes a second projection extending into the coils of said second compression spring.

9. An electrical switching apparatus comprising:

a housing;

a number of a stationary contacts;

a number of movable contacts;

a number of moving arms, each of said movable contacts being disposed on a corresponding one of said moving arms; and a crossbar assembly comprising:

a crossbar for pivoting said moving arms thereby moving said movable contacts into and out of electrical communication with said stationary contacts, said crossbar having a number of molded recesses, a pair of contact springs disposed in each of said molded recesses, a spring clip enclosing said pair of contact springs within said molded recess, said spring clip being disposed between a corresponding one of said moving arms and said pair of contact springs, and a spring cap cooperating with said pair of contact springs within said molded recess, each spring cap comprising:

a first segment disposed between said spring clip and a first contact spring of said pair of contact springs, a second segment disposed between said spring clip and a second contact spring of said pair of contact springs, and a connecting portion connecting the first segment to the second segment, wherein said spring cap supports said spring clip and evenly distributes bias forces of said first contact spring and said second contact spring, wherein said spring clip has a predetermined geometry including a plurality of bends; wherein the first segment and the second segment together form a contact surface having a predetermined profile; wherein said predetermined profile comprises a plurality of angled surfaces; and wherein each of said angled surfaces engages said spring clip between a corresponding pair of said bends, and wherein said plurality of angled surfaces includes a first ramped portion disposed at a first angle and a second ramped portion disposed at a second angle different from the first angle.

10. The electrical switching apparatus of claim 9 wherein each of said spring caps is a unitary member consisting of one single piece of material; and wherein said connecting portion is a molded web of material interconnecting the first segment and the second segment.

11. The electrical switching apparatus of claim 10 wherein said molded web of material functions as a rejection feature to only permit said spring cap to be disposed within said molded recesses in one single predetermined orientation.

12. The electrical switching apparatus of claim 9 wherein said first contact spring is a first compression spring having a plurality of coils; wherein said second contact spring is a second compression spring having a plurality of coils; wherein the first segment includes a first projection extending into the coils of said first compression spring; and wherein the second segment includes a second projection extending into the coils of said second compression spring.

13. The electrical switching apparatus of claim 9 wherein said electrical switching apparatus is a circuit breaker; wherein said circuit breaker includes a plurality of poles; wherein said crossbar includes a plurality of molded recesses for the poles of said circuit breaker; and wherein said crossbar assembly comprises a pair of contact springs disposed in each of said molded recesses, a plurality of spring clips each securing a corresponding pair of contact springs within a corresponding molded recess, and a plurality of spring caps each supporting a corresponding spring clip and evenly distributing bias forces of a corresponding pair of contact springs.

* * * * *